United States Patent [19]

Nelsen

[11] Patent Number: 4,778,103

[45] Date of Patent: Oct. 18, 1988

[54] SELF-CONTAINED MAILBOX SIGNAL DEVICE

[76] Inventor: Milton Nelsen, Taylor Hill Rd., R.R. 2, Box 107, Granville, N.Y. 12832

[21] Appl. No.: 138,564

[22] Filed: Dec. 28, 1987

[51] Int. Cl.[4] ..... B65D 91/00

[52] U.S. Cl. ..... 232/35; 232/34

[58] Field of Search ..... 232/35, 34, 17

[56] References Cited

U.S. PATENT DOCUMENTS 2,797,860 7/1957 Foster ..... 232/35

2,859,913 11/1958 Paschke et al. ..... 232/35

*Primary Examiner*—Robert W. Gibson, Jr.

*Attorney, Agent, or Firm*—Heslin & Rothenberg

[57] ABSTRACT

An auxillary mailbox signal device designed to indicate when mail has been in a mail receptacle and which is adapted to be selectively mounted to a standard mailbox without the need for ancillary connecting or mounting means integral with the mailbox structure is provided. The signal device includes a base portion having two spaced transverse slots therein positioned and sized to frictionally engage two downwardly extending bottom flanges of the mail receptacle. A signal arm is pivotally secured to one end of the elongated base portion so as to be rotatable between a lowered, substantially horizontal position and a raised, substantially vertical position. Tab means is secured to the signal arm in fixed relation such that when the device is attached to the receptacle with the signal arm in its lowered position and the mailbox door closed, the tab means engages the mailbox door so that with the opening of the door, the signal arm is pivoted from its non-signal horizontal position to its vertical signal position. An enhanced version of the signal device includes an upright arm at each end of the base portion positioned to engagably contact one receptacle sidewall, and releasable clamping means for compressing the upright arms against the sidewalls.

16 Claims, 4 Drawing Sheets

SELF-CONTAINED MAILBOX SIGNAL DEVICE

BACKGROUND OF THE INVENTION

The present invention relates to an auxillary mailbox signal device designed to indicate when mail has been placed in a mail receptacle and which is adapted to be selectively mounted to a standard mailbox without the need for ancillary connecting or mounting means integral with the mailbox structure.

Although many signalling devices for mailboxes for indicating whether mail has been placed in the box are known, most such devices are so constructed or secured as to be integral with the mail receptacles with which they are used. Even with the simplist of these prior art devices, it is necessary to drill holes into or otherwise violate the integrity of the mailbox structure itself. In addition, many of the existing signalling devices are complicated, utilizing sophisticated linkage mechanisms which are expensive and difficult to fabricate.

A few examples of the less complicated prior art devices are disclosed in U.S Pat. Nos. issued to Smith, 4,190,193, Wideman, 4,158,430, Stouten, 2,852,185 and Jones, 932,287. Of the known prior art patents, the Smith patent, U.S. Pat. No. 4,190,193, appears to be the only signal device assembly designed to be installed upon a mailbox in such a manner so as not to violate the structural integrity of the box. Smith describes a flexible band support member defined by two separate portions interconnected by a nut and bolt tightening means assembly. The flexible band support member is substantially U-shaped when assembled about a standard mailbox. Each of its free ends is configured to bend around and thereby engage the lower longitudinal side flanges extending downwardly along the side of the standard mailbox. The bolt tightening means assembly is adjusted as necessary to secure the flexible band about the mailbox.

Although the Smith flexible band support member does appear to accomplish its intended function, an even less complicated signalling device structure which can be more readily selectively installed and/or removed from a standard mailbox without violating the structural integrity thereof and which does not require complicated linkage mechanisms in operation is believed desirable.

SUMMARY OF THE INVENTION

Accordingly, it is a principle object of the of the present invention to provide a mailbox signal device which is easily attachable to a standard mail receptacle without violating the structural integrity thereof, and which attaches to the mail receptacle in a less complicated manner than any heretofore known device.

A further object of the present invention is to provide such a mailbox signalling device which does not require complicated linkage mechanisms to operate.

A yet further object of the present invention is to provide a readily attachable and detachable signal device for a mailbox which is automatically tripped when the mailbox door is opened so that a signal is given that mail has been deposited in the box.

Briefly, the present invention satisifies these objects by providing a self-contained mailbox signal device for attachment to a standard mail receptacle. The signal device includes an elongated base portion which has two spaced transverse slots therein positioned and sized to frictionally engage two downwardly extending bottom flanges of the mail receptacle. A signal arm is pivotally secured to one end of the elongated base portion such that when the device is secured to the mail receptacle, the arm is spaced substantially parallel to one sidewall of the receptacle and is rotatable between a lowered, substantially horizontal position and a raised, substantially vertical position. Lastly, tab means is secured to the signal arm in fixed relation such that when the device is attached to the receptacle with the signal arm in its lowered position and the mailbox door closed, the tab means engages the mailbox door so that upon opening of the door, the signal arm is pivoted from its non-signal horizontal position to its vertical signal position. The frictionally engaging, flange receiving slots within the base portion allow the device to be readily attached to and detached from the standard mail receptacle.

In accordance with a further embodiment of the invention, the base portion includes two upright arms, one upright arm being positioned at each end of the base to engagably contact one receptacle sidewall, and releasable clamping means are provided for pressing the upright arms against the sidewalls.

In an alternate embodiment of the invention, the self-contained mailbox signal device includes an elongated base portion having two upright arms located at opposite ends thereof. The base portion is sized such that when positioned below the bottom of the mail receptacle the upright arms engagably contact the vertical sidewalls of the receptacle. Releasable clamping means is provided for pressing the upright arms against the sidewalls. As with the other embodiments, a signal arm is pivotally secured to one end of the elongated base portion such that when the device is secured to the mail receptacle, the arm is spaced substantially parallel to one sidewall of the receptacle and is rotatable between a lowered, substantially horizontal position and a raised, substantially vertical position. Lastly, tab means is secured to the signal arm in fixed relation such that when the device is attached to the receptacle with the signal arm in its lowered position and the mailbox door closed, the tab means engages the mailbox door so that with the opening of the door the signal arm is pivoted from its non-signal horizontal position to its vertical signal position. The releasable upright arm clamping means allows the signal device to be readily attached to and detached from the standard mail receptacle without violating the integrity of the receptacle.

BRIEF DESCRIPTION OF THE DRAWINGS

While the specification concludes with claims particularly pointing out in distinctly claiming the present invention, the objects, features and advantages of the present invention can be more readily ascertained from the following detailed description of one preferred embodiment when read in conjunction with the accompanying drawings in which:

Figure 1:
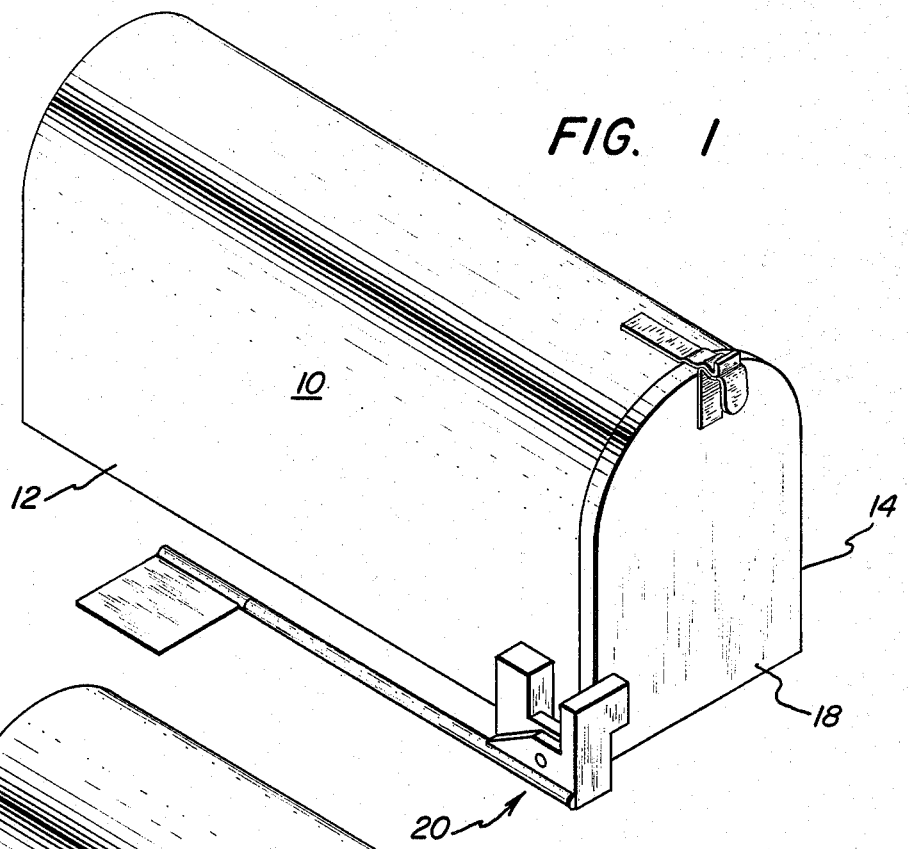
FIG. 1 a is perspective view of the combination of a conventional mailbox and the signal device of the present invention, shown with its signal arm in a lowered, non-signal position.
Figure 2:
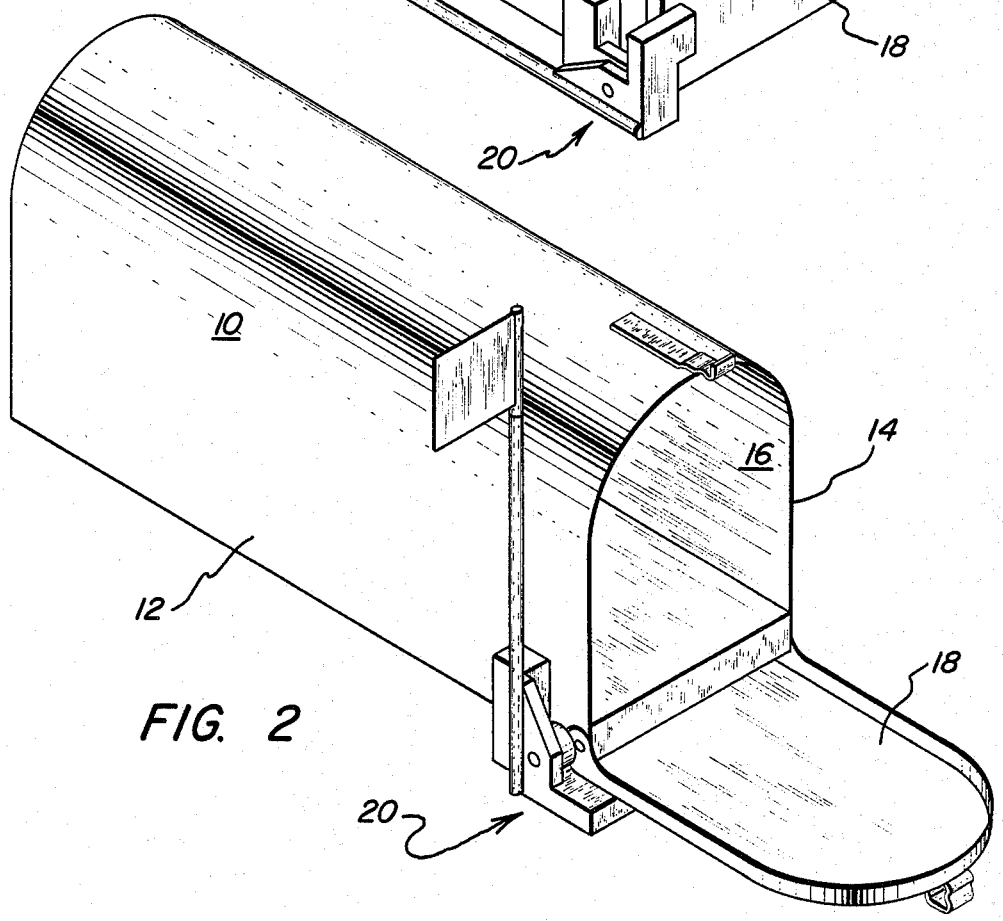
Figure 3:
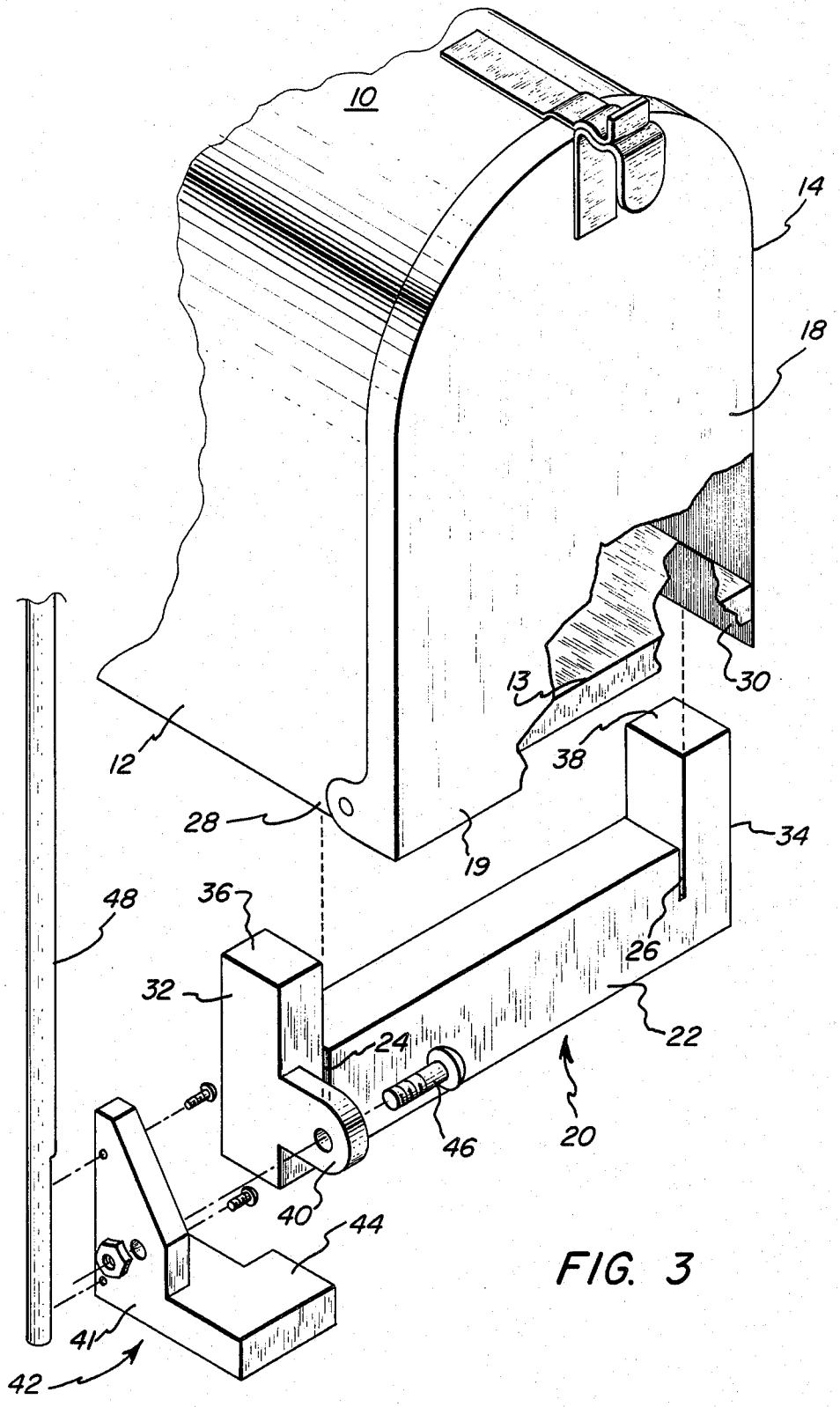
Figure 4:
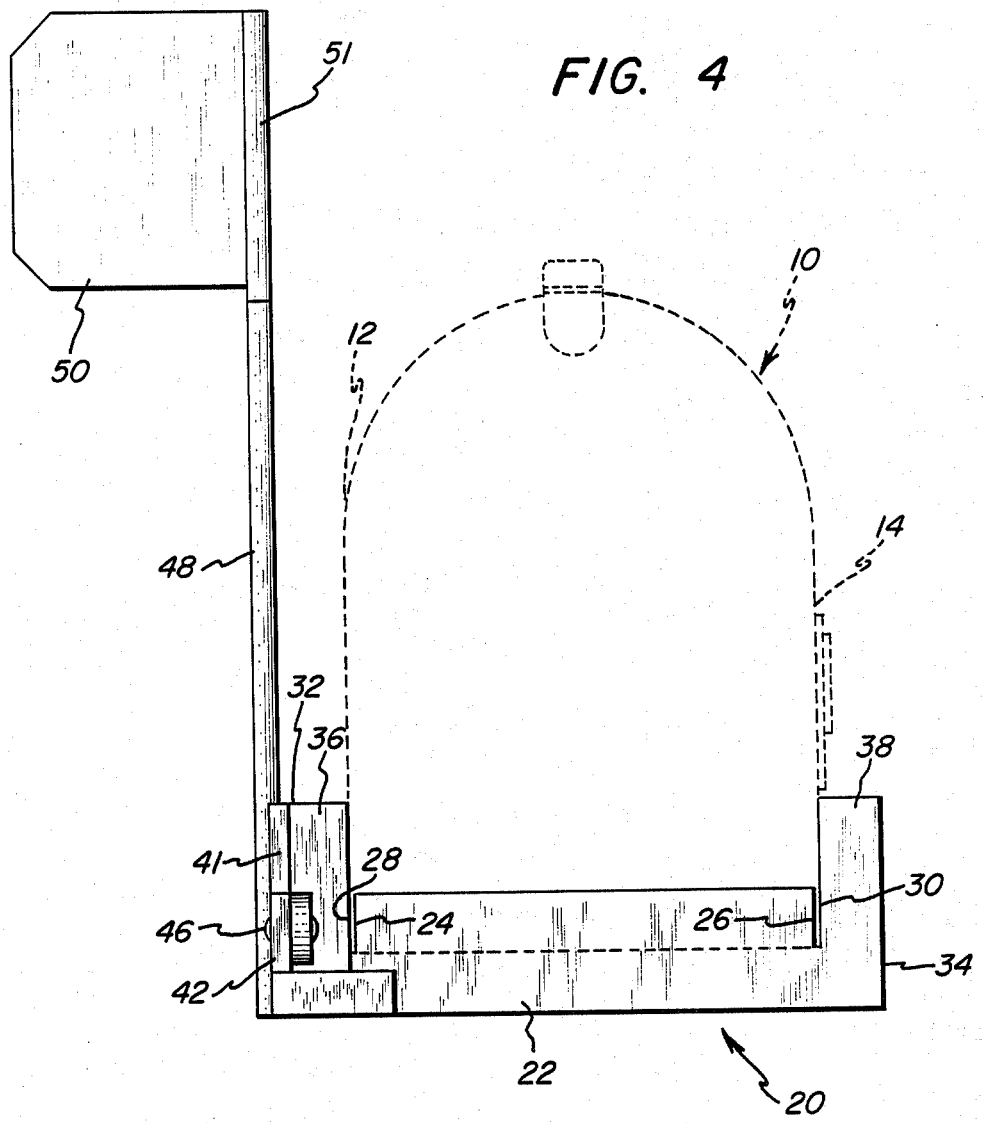
Figure 5:
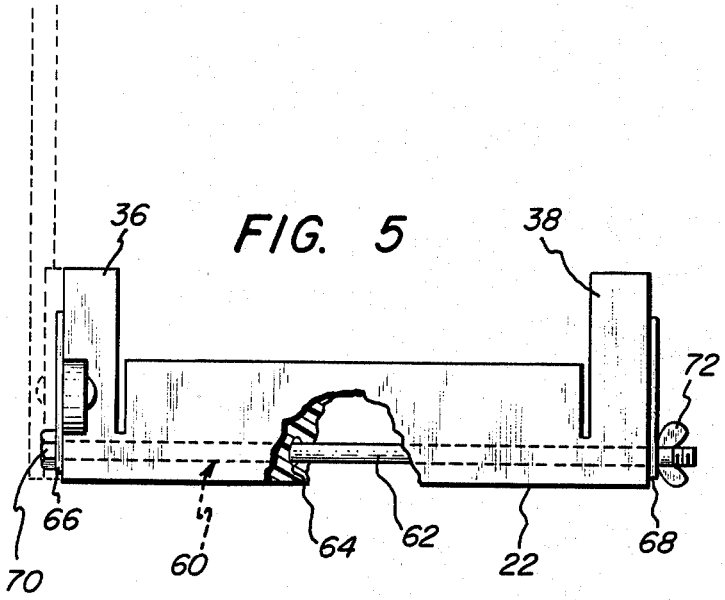
Figure 6:
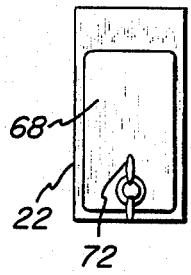
Figure 7:
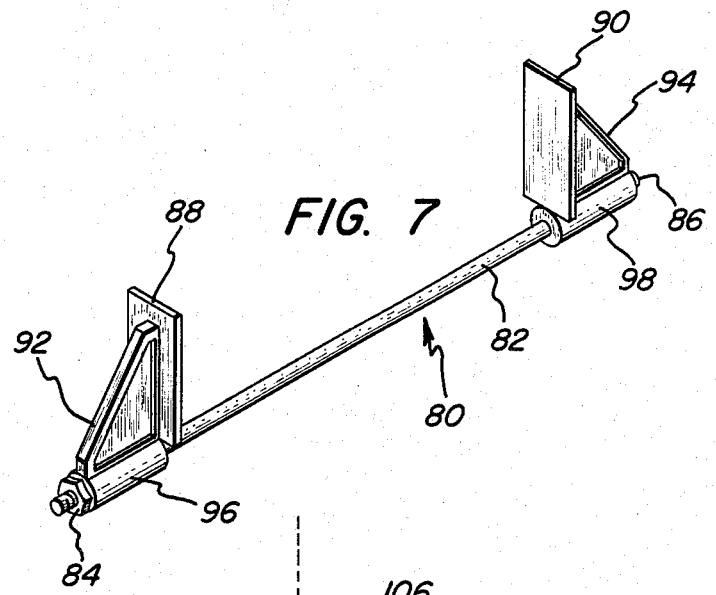
Figure 8:
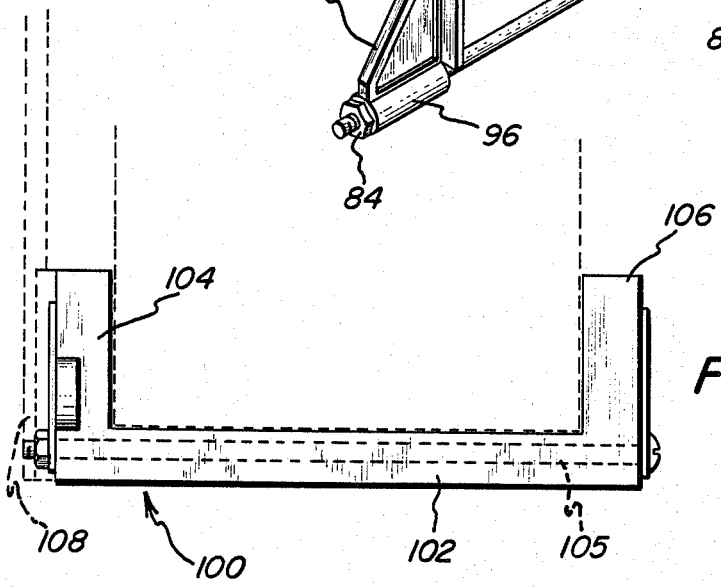

Fig. a perspective view of the combination of FIG. 1 with the signal arm shown in its raised, signal position;

FIG. 3 is an exploded perspective view of the conventional mailbox and signal device combination of FIG. 2;

FIG. 4 is a front elevational view of the signal device of the present invention, with the conventional mailbox shown in phantom;

FIG. 5 is a partially cutaway, front elevational view of an alternate embodiment of the signal device of the present invention;

FIG. 6 is an end elevational view of the signal device of FIG. 5;

FIG. 7 is a perspective view of an alternate form of the clamping means utilied in the signal device embodiment FIG. 6; and FIG. 8 is a partially cutaway, front elevational view of another alternate embodiment of the signal device of the present invention.

DETAILED DESCRIPTION OF THE INVENTION

Referring in detail to FIGS. 1–4, a conventional regulation type mailbox 10 is shown having two substantially vertical sidewalls 12 & 14, a bottom 13, and an open end 16 to which an outwardly downwardly swinging door 18 is pivotally attached. Door 18 is capable of sealing off open front end 16 of box 10 when in a closed position.

As best shown in FIGS. 3 & 4 of the drawings, one preferred embodiment of the self-contained mailbox signal device 20 of the present invention comprises an elongated base 22 having two transverse slots 24 and 26 therein positioned and sized to frictionally engage downwardly extending flanges 28 and 30, respectively, which are standard fixtures on the bottom 13 of most rural mailboxes. Fixedly secured at each end 32 and 34 of base 22 are upright arms 36 and 38, respectively, which are appropriately positioned to engage sidewalls 12 and 14 of mailbox 10 to enhance frictional engagement of device 22 to box 10. If desired, base 22 and arms 36 and 38 can be constructed unitarily. Also, device 20 can be constructed of any desired material, such as wood or plastic.

Secured at end 32 of base 22 is a forwardly protruding arm 40, discussed further below, to which the pivoting flag assembly 42 of device 20 is attached. Assembly 42 includes a pivoting member 41 having a tab 44 so positioned at one end as to engagably contact door 18. Also secured to member 41 is a signal arm 48, which has a flag 50 at its free end 51. Preferably, flag 50 is adjustable about arm 48 to enhance the signalling capability of device 20 in any particular, desired direction. Assembly 42 is pivotally secured to arm 40 by an adjustable friction inducing bolt 46.

Forwardly protruding arm 40 connected to base 22 functions to appropriately space tab 44 of flag assembly 42 in engagement with door lS of box 10 with the base of device 20 positioned a spaced distance back, e.g., one inch, from front end 16 of mailbox 10. Spacing base 22 back from the front of box 10 is necessary because door 18 typically has a downwardly extending lip 19 which must be free to pivot backwards to a substantially horizontal position below bottom 13 of box 10 when door 18 is fully opened. Protruding arm 40 thus allows base 22 to be so positioned without affecting performance of the device or the mailbox to which it is attached, and at the same time arm 40 provides a convenient structure for the attachment of pivoting assembly 42. In an alternate embodiment, device 20 could be structured such that pivoting assembly 42 is secured directly to one end of base 22 in which case door engaging tab 44 would have a substantially L-shaped configuration to provide the necessary clearance space between base 22 and bottom lip 19 of door 18.

In operation, device 20 is frictionally secured to flanges 28 and 30 of mailbox 10 such that when signal arm 48 of pivoting assembly 42 is in its substantially horizontal "non-signal" position and door 18 is in its closed position, tab 44 engagably contacts the door (see FIG. 1). When door 18 is opened, tab 44 is pivoted downwardly while signal arm 48 is raised to its substantially vertical "signal" position with flag 50 clearly visible to a remote observer, thus indicating that mail has been placed in the mailbox (see FIG. 2). After mail has been removed from box 10, signal arm 48 is rotated to its horizontal "non-signal" position, e.g., by moving tab 44 upwards to engage door 18. Thus, the signal device is ready to again signal the arrival of mail to a remote observer.

An alternate, enhanced version of the invention includes the use of clamping means to guarantee, in combination with the frictionally engaging transverse slots in base 22, the securement of device 20 to mailbox 10. One embodiment of clamping means 60 is illustrated in FIGS. 5 & 6. As shown, clamp 60 includes a bolt 62 positioned within a longitudinally extending bore 64 in base 22. At each end of base 22, side plates 66 and 68, manufactured of a hardened material such as metal, are positioned to at least partially engage the outside surface of upright arms 36 and 38, respectively. Each side plate 66 and 68 has a hole therein (not shown) aligned with and substantially the same size as bore 64 in base 22 such that bolt 62 passes through each side plate. One end of bolt 62 has a fixed head 70 secured thereto, and the opposite end is threaded and includes a threadably adjustable wing nut 72 such that bolt 62 is capable of being adjusted to apply any desired compressive force to side plates 66 and 68, pressure which is transferred to upright arms 36 and 38 and sidewalls 12 & 14, respectively, of mailbox 10. Lastly, use of clamping means 60 requires some modification of pivoting assembly 42 to ensure proper performance, e.g., pivoting member 41 can be reconfigured to avoid contact with head 70 of bolt 62.

FIG. 7 illustrates an alternate embodiment of the clamp means utilized in the enhanced version of the present invention. Clamp means 80 includes bolt 82 having a nut 84 threadably secured at one end and a fixed slotted head 86 at the other end. In this version, flat side plates 88 and 90 are reinforced by triangular shaped buttressing or support plates 92 and 94, respectively. Unitary with and at the bottom of each side plate and support plate combination is a tubular member 96 and 98, respectively, through which bolt 82 passes as illustrated.

Lastly, a further alternate embodiment of the present invention is illustrated in FIG. 8. In this embodiment, mailbox signal device 100 includes a base portion 102 having upright extending arms 104 and 106 at each end. Clamp means 105, e.g., as discussed above with reference to FIGS. 5–7, extending through base 102 allows for the application of compressive forces to upright extending arms 104 and 106. Base 102 and arms 104 and 106 are sized such that when located below the bottom of a conventional mailbox, the upright extending arms engage opposite sidewalls of the box. As described with respect to the other embodiments of the present invention, device 100 includes a pivoting assembly 108 having a signal arm secured thereto, and is capable of selective attachment to and detachment from a conventional mailbox without violating the structural integrity of the box.

From the foregoing detailed description, it will be noted that this invention fully meets the objective set forth. A mailbox signal device readily attachable to a convention mailbox in a less complicated manner than heretofore known devices, without violating the structural integrity thereof, is provided. In addition, the signal device does not require a complicated linkage mechanism to operate and is automatically tripped when the mailbox door is opened so that a signal is given that mail has been deposited in the box.

Although several embodiments have been illustrated in the accompanying drawings and described in the foregoing detailed description, it will be understood that the invention is not limited to the particular embodiments discussed but is capable of numerous rearrangements, modifications and substitutions without departing from the scope of the invention. The following claims are intended to encompass all such modifications.

I claim:

1. A self-contained mailbox signal device for attachment to a standard mail receptacle having at least one substantially vertical sidewall, a bottom including at least two downwardly extending flanges, and an open front end capable of being closed by an outwardly downwardly swinging door pivotally mounted thereto, said signal device comprising:

an elongated base portion having two spaced transverse slots therein positioned and sized to frictionally engage the at least two downwardly extending bottom flanges of the mail receptacle;

a signal arm pivotally secured to one end of said elongated base portion such that when said device is attached to the mail receptacle, said arm is spaced substantially parallel to said at least one sidewall and is rotatable between a lowered, substantially horizontal position and a raised, substantially vertical position; and tab means secured to said signal arm in fixed relation such that when said device is attached to the mail receptacle with said signal arm in its lowered position and the door closed, said tab means engages said door so that with the opening of said door said signal arm is pivoted from its lowered substantially horizontal position to its raised substantially vertical position, whereby the elongated base portion having flange receiving slots therein allows said signal device to be readily attached to and detached from the standard mail receptacle.

2. The signal device of claim 1, wherein the mail receptacle has two substantially vertical sidewalls and wherein said elongated base portion includes two upright arms, each upright arm being secured to an opposite end of said base portion so as to engagably contact one of said sidewalls when said device is attached to the mail receptacle.

3. The signal device of claim 2, further comprising means for releasably clamping said upright arms against said sidewalls.

4. The signal device of claim 3, wherein said base portion has a longitudinally extending bore therethrough and said clamping means comprises:

two side plates, each of said side plates being outside and engagably contacting one of said upright arms at opposite ends of said base portion; and compressive adjustment means interconnecting said side plates through said base portion bore such that clamping forces may be selectively applied to said side plates.

5. The signal device of claim 4, wherein each of said side plates has a hole wherein, said side plate holes being aligned with said longitudinally extending bore in said base portion, and wherein said compressive adjustment means comprises a bolt positioned within said longitudinal bore and extending through each of said side plate holes, one end of said bolt having a fixed head secured thereto and the other end being threaded, said threaded end having a threadably adjustable nut secured thereto.

6. The signal device of claim 4, wherein said side plates each include buttressing means positioned substantially perpendicular to the side walls of the mail receptacle.

7. The signal device of claim 1, wherein the elongated base portion includes a forwardly extending arm secured at one end, said signal arm being connected to said extending arm, said extending ar being sized to position said base portion at a spaced distance back from the front end of the mail receptacle to avoid contacting the lower end of the mailbox door when said door is opened.

8. The signal device of claim 1, wherein the elongated base portion, signal arm, and tab means are manufactured of wood.

9. The signal device of claim 1, wherein the elongated base portion, signal arm, and tab means are manufactured of plastic.

10. The signal device of claim 1, wherein said pivotal securement of the signal arm to one end of said elongated base portion includes adjustable friction inducing means for ensuring that said signal arm remains in its substantially vertical position when raised.

11. The signal device of claim 1, wherein said signal arm includes a signal flag adjustably secured thereto.

12. An improved mailbox combination comprising:

a standard mail receptacle having at least one substantially vertical sidewall, a bottom including at least two downwardly extending flanges, and an open front end capable of being closed by an outwardly downwardly swinging door pivotably mounted thereto; and a detachable signal device having an elongated base portion with two spaced transverse slots therein postioned and sized to frictionally engage the at least two downwardly extending bottom flanges of the mail receptacle, a signal arm pivotally secured to one end of the elongated base portion such that when said device is attached to the mail receptacle said arm is spaced substantially parallel to said at least one sidewall and is rotatable between a lowered substantially horizontal position and a raised substantially vertical position, and tab means secured to said signal arm in fixed relation such that when said device is attached to the mail receptacle with said signal arm in its lowered position and the mailbox door closed, said tab means engages said door so that with the opening of said door said signal arm is pivoted from its lowered substantially horizontal position to its raised substantially vertical position, whereby the elongated base portion having flange receiving slots therein allows said signal device to be readily attached to and detached from the standard mail receptacle.

13. A self-contained mailbox signal device for attachment to a mail receptacle having two substantially vertical sidewalls, a bottom, and an open front end capable of being closed by an outwardly downwardly swinging door pivotally mounted thereto, said signal device comprising:

an longated base portion having two upright arms, each upright arm being located at an opposite end of said base portion, said base portion being sized such that when positioned below the bottom of said mail receptacle, said upright arms engagably contact the vertical sidewalls of said mail receptacle;

a signal arm pivotally secured to one end of said elongated base portion such that when said device is attached to the mail receptacle, said arm is spaced substantially parallel to one of said sidewalls and is rotatable between a lowered, substantially horizontal position and a raised, substantially vertical position;

tab means secured to said signal arm in fixed relation such that when said device is attached to the mail receptacle with said signal arm in its lowered position and the door closed, said tab means engages said door so that with the opening of said door, said signal arm is pivoted from its lowered substantially horizontal position to its raised substantially vertical position; and means for releasably clamping said upright arms against said sidewalls, whereby said upright arm clamp means allows said signal device to be readily attached to and detach from the standard mail receptacle without violating the integrity of the receptacle.

14. The signal device of claim 13, wherein said base portion has a longitudinally extending bore therethrough and said clamping means comprises:

two side plates, each of said side plates being outside and engagably contacting one of said upright arms at opposite ends of said base portion; and compressive adjustment means interconnecting said side plates through said base portion bore such that clamping forces may be selectively applied to said side plates.

15. The signal device of claim 14, wherein each of said side plates has a hole therein, said side plate holes being aligned with said longitudinally extending bore in said base portion, and wherein said compressive adjustment means comprises a bolt positioned within said longitudinal bore and extending through each of said side plate holes, one end of said bolt having a fixed head secured thereto and the other end being threaded, said threaded end having a threadably adjustable nut secured thereto.

16. The signal device of claim 14, wherein each of said side plates include buttressing means positioned substantially perpendicular to the side walls of the mail receptacle.

* * * * *

UNITED STATES PATENT AND TRADEMARK OFFICE

CERTIFICATE OF CORRECTION

PATENT NO. : 4,778,103

DATED : 10/18/88

INVENTOR(S) : Milton Nelsen

It is certified that error appears in the above-identified patent and that said Letters Patent is hereby corrected as shown below:

- Claim 5, line 6, "wherein" should read "therein";

Claim 7, line 21, "ar" should read "arm";

Claim 13, line 7, "longated" should read "elongated".

Signed and Sealed this

Fourteenth Day of March, 1989

*Attest:*

DONALD J. QUIGG

*Attesting Officer*

*Commissioner of Patents and Trademarks*